United States Patent [19]

Lemke, Jr.

[11] 3,997,161

[45] Dec. 14, 1976

[54] TABLE-TENNIS BAT

[75] Inventor: Paul Lemke, Jr., Schleswig, Germany

[73] Assignee: Paul Lemke Fabrik fur Sportartikel-Export, Schleswig, Germany

[22] Filed: Aug. 6, 1974

[21] Appl. No.: 495,187

[30] Foreign Application Priority Data

Aug. 6, 1973 Germany ..... 7329025[U]
Jan. 21, 1974 Germany ..... 2402725

[52] U.S. Cl. ..... 273/76

[51] Int. Cl.[2] ..... A63B 59/04

[58] Field of Search ..... 273/67 R, 67 A, 67 D, 273/67 DA, 72 R, 73 R, 73 F, 73 J, 76, 80.9, 82 R; 124/23 R; 280/11.13 L

[56] References Cited

UNITED STATES PATENTS

| | | | |
|---|---|---|---|
| 1,682,504 | 8/1928 | Hall | 273/73 F |
| 1,831,350 | 11/1931 | Hall | 273/73 F |
| 2,000,316 | 5/1935 | Bentley | 273/73 J |
| 2,152,239 | 3/1939 | Burnard | 273/76 |
| 2,205,578 | 6/1940 | Schnur | 273/76 X |
| 2,414,125 | 1/1947 | Rheinfrank | 273/73 F UX |
| 2,428,325 | 9/1947 | Collins | 273/DIG. 7 |
| 2,525,618 | 10/1950 | Pierce | 280/11.13 L |
| 2,626,804 | 1/1953 | Robinson | 273/73 F |
| 2,695,178 | 11/1954 | Rheinfrank | 280/11.13 L |
| 2,875,117 | 2/1959 | Potchen et al. | 273/DIG. 7 |
| 2,912,245 | 11/1959 | Gardner et al. | 273/67 A |
| 3,879,035 | 4/1975 | Danchulis et al. | 273/73 C |
| 3,879,250 | 4/1975 | Rankin | 273/76 X |

FOREIGN PATENTS OR APPLICATIONS

| | | | |
|---|---|---|---|
| 241,018 | 2/1960 | Australia | 273/DIG. 7 |
| 948,469 | 1/1949 | France | 273/76 |
| 515,748 | 1/1931 | Germany | 273/76 |
| 178,843 | 6/1954 | Germany | 273/76 |
| 776,065 | 6/1957 | United Kingdom | 273/73 F |
| 485,068 | 5/1938 | United Kingdom | 273/67 A |
| 637,779 | 5/1950 | United Kingdom | 273/67 A |
| 607,255 | 8/1948 | United Kingdom | 273/76 |

*Primary Examiner*—Richard J. Apley
*Attorney, Agent, or Firm*—Beall & Jeffery

[57] ABSTRACT

The invention concerns a table-tennis bat in which the core, which extends throughout the bat, is a lightweight wood and in which on each side of said core there is provided a lamina of considerably harder wood. The bat has the usual playing surface coating such as dimpled or foam rubber.

7 Claims, 4 Drawing Figures

FIG.1
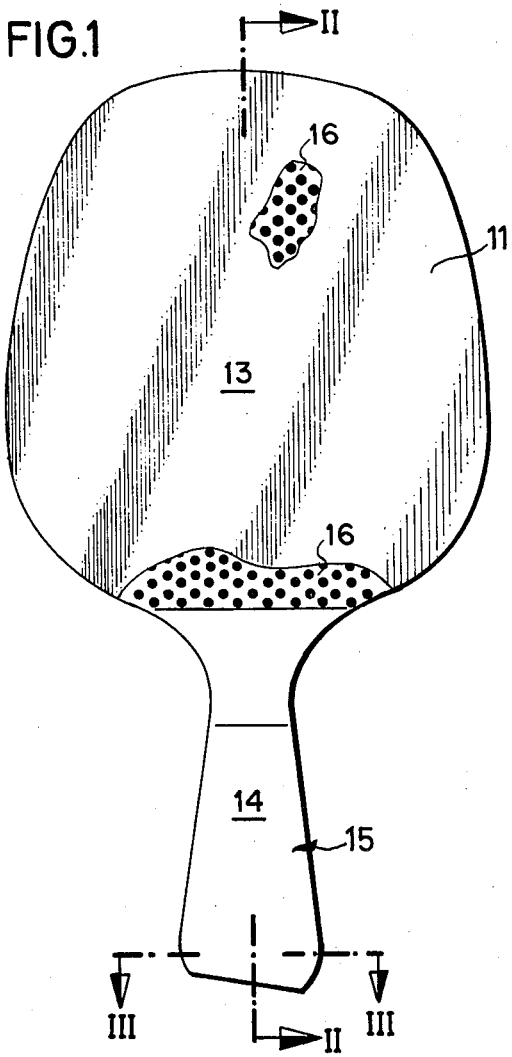
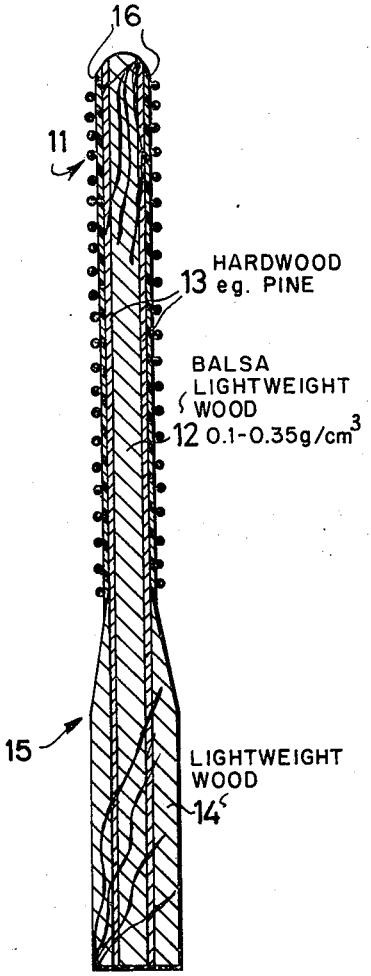
FIG.2
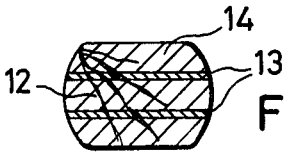
FIG.3
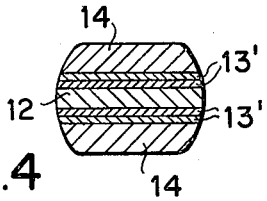
FIG.4

TABLE-TENNIS BAT

The invention relates to a wooden table-tennis bat in which the wood extends throughout the area of the handle and blade, or playing surface with a playing coating of dimple rubber, foam rubber or the like applied to it.

As well as the usual bats of the kind described above it has been proposed to use thermoplastics material in some bats. From West German Gebrauchsmuster No. 6,901,244 there is known a bat in which the foundation consists of foamed thermoplstic plastics and forms one piece with the blade and handle. It is also known (see, e.g., German Gebrauchsmuster Nos. 7,108,376 or 7,034,351) to provide a core consisting of aluminum or a combination of a plastics honeycomb and aluminium.

In spite of the various efforts hitherto made in this field it must be stated that in practice there is no table-tennis bat which fulfills in sum the requirements laid down for a table-tennis bat which are, namely to exhibit at the same time low weight, high strength and good rebound resonance. Thus, for example, in the case of the aforesaid aluminum bat with or without plastics honeycombe the rebound resonance is too great, and in the case of the usual wooden bats it is again not correct. For these reasons today bats are still made of plywood, the plywood being glued in three to five layers usually which are provided with rubber, dimple rubber and/or a foam rubber coating and having a particularly compact foam rubber foundation. In addition, bats of plastics or metal and also composite bats of these materials cannot be used as tournament or match bats because in accordance with the relevant international rules such materials are not permitted.

The object of the invention is to produce a table-tennis bat which fulfills all the aforesaid requirements, at the same time satisfying the extreme conditions imposed upon bats by strenuous sport and moreover fulfilling the specification of the international table-tennis rules.

In accordance with the invention a table tennis bat comprises a core of lightweight wood extending throughout the area of the handle and blade of the bat, a lamina of wood considerably harder than that of the core being provided on each side of the core, and a playing surface coating such as dimpled rubber provided on each lamina. One wood of which the core may be formed is balsa wood.

The laminae may consist of a combinaion of woods of different hardnesses, whilst the handle may include further layers of the same wood as the core.

The advantages of the invention lie in particular in the fact that there is achieved by the combination of lightweight wood as the core of the bat and harder wood as the outer coating a bat of lower weight, but above all a particularly high strength compound construction.

This light wood/hard wood combination ensures the necessary good rebound resonance, and possibilities of very widely differing variations in the hardness of the bat allowing a bat to be tailor made for an individual player and his style of play. In other words variation in the basic rebound resonance is made possible by different coating of the lightweight wood core whilst still preserving the low weight and adequate strength. Practically any desired rebound resonance can be achieved by selection of the lamina material(s) on the one hand and the thickness of it on the other.

Through the coating of wood a quite oustanding feel of the ball is communicated to the player because the vibration of the bat, in contrast to the plastics and metal bats described above, is transmitted quite outstandingly to the hand holding it. Productionwise no particular difficulties exist or arise, since bats in accordance with the invention can be produced like the conventional plywood bats and hence demand no new or special production methods. As compared with a plywood bat, however, with a considerably lower weight a stronger rebound of the ball is achieved and hence higher ball speeds.

It is the desire of the majority of table-tennis players to have available a bat as fast as possible, so that the play becomes on the whole faster and the reaction times become shortened, thus making the play more interesting. This enhanced play-incentive naturally increases the chances of sale and turnover of bats. Finally, because the handle may also consist of further layers of the lightweight wood, applied to the blade in accordance with known production methods, there is achieved besides the saving in weight the advantage of a particularly good grip. In other words a bat in accordance with the invention lies easily in the hand and is characterized by particularly good non-slip qualities, so that additional windings of leather, cork or the like usual for this purpose can be dispensed with.

The term "lightweight wood" employed in the foregoing also embraces such woods as are usual in the trade under the designation "softwood," in so far as they exhibit the characteristic of low weight demanded by the invention. Thus, to name but one example the mass density of balsa wood lies approximately between 0.1 and 0.2 g/cm$^3$.

One example of a table tennis bat according to the invention will now be described with reference to the accompanying drawings, in which:

FIG. 1 is an elevation of a table-tennis bat with the playing surface omitted;

FIG. 2 is a longitudinal section along the line II—II in FIG. 1;

FIG. 3 is a section along the line III—III in FIG. 1; and

FIG. 4 is a cross sectional view similar to FIG. 3, but of a modification.

The table-tennis bat shown consists in known manner of a blade 11 and a handle 15. The blade 11 carries the playing surface coating which may consist of dimple rubber, foam rubber or any other materials considered suitable, which is conventioanl and has been shown in FIG. 2 in cross section and only partially in FIG. 1 although it is understood that the entire blade portion 11 is to be covered on both sides with the playing surface 16 as indicated in FIG. 2.

The bat has a continuous core 12 of balsa wood, shaped to the outline of the bat, i.e., embracing the blade 11 and the handle 15. This continuous core 12 is provided on both its flat faces with a coating 13 of hard, strength-increasing wood, for example, pine. This coating 13 extends across the whole area of the core 12. For shaping the handle 15 lightweight wood is applied at 14 in this zone, and firmly glued or fastened with other appropriate means to the outer faces of 13. Each of the coatings 13 may consist of a plurality of wood lamina of different hardenings, as shown in the modification of FIG. 4 at 13'. Otherwise, the modification of FIG. 4 is identical to the structure previously described.

It will be recognized that the handle 15 besides low weight obtains considerable rigidity which is to be attributed to the compound arrangement with the coating 13, so that the springiness of known one-piece added handles no longer occurs.

The term lightweight wood includes more particularly those woods which have a mass density between 0.1 and 0.35 g/cm$^3$.

What I claim as my inventon and desire to secure by Letters Patent is:

1. A table-tennis bat defined by a relatively narrow handle portion and a relatively wide flat table-tennis ball striking blade portion, comprising: a core sheet of lightweight wood having a mass density of 0.1 to 0.35 g/cm$^3$ and extending throughout the area of the handle portion and the blade portion of said bat; on each side of said core sheet, a lamina sheet of wood considerably harder than the wood of said core sheet and generally coextensive with said core sheet; and an elastomeric outermost sheet joined to the outer surface of each lamina sheet providing a playing surface throughout said blade portion.

2. A table-tennis bat according to claim 1, wherein said laminae each consist of a plurality of wood layers of different hardness.

3. A table-tennis bat according to claim 1, wherein said lightweight wood is balsa wood having a mass density between 0.1 and 0.2g/cm$^3$.

4. A table-tennis bat according to claim 3, wherein said laminae consist of pine.

5. A table-tennis bat according to claim 1, wherein said lightweight wood is balsa wood.

6. A table-tennis bat according to claim 1, wherein said laminae consist of pine.

7. A table-tennis bat according to claim 1, further including layers of said lightweight wood respectively secured to the outer side of each lamina only within the handle portion and forming at least the major exposed hand-grip surface.

* * * * *